US005343726A

United States Patent [19]

Reth

[11] Patent Number: 5,343,726

[45] Date of Patent: Sep. 6, 1994

[54] ROLLING TRAIN FOR ROLLING GIRDER SECTIONS

[75] Inventor: Erich Reth, Duisberg, Fed. Rep. of Germany

[73] Assignee: Mannesmann Aktiengesellschaft, Dusseldorf, Fed. Rep. of Germany

[21] Appl. No.: 956,719

[22] Filed: Oct. 2, 1992

[30] Foreign Application Priority Data

Oct. 2, 1991 [DE] Fed. Rep. of Germany ..... 4133072

[51] Int. Cl.[5] ..... B21B 1/12

[52] U.S. Cl. ..... 72/225; 72/229; 72/235

[58] Field of Search ..... 72/225, 229, 234, 235, 72/366.2

[56] References Cited

U.S. PATENT DOCUMENTS

| | | | |
|---|---|---|---|
| 1,812,248 | 6/1931 | Oberg | 72/235 |
| 4,366,694 | 1/1983 | Pariseau et al. | 72/235 |
| 4,669,293 | 6/1987 | Kusaba et al. | 72/235 |
| 4,791,799 | 12/1988 | Engel et al. | 72/235 |
| 5,020,354 | 6/1991 | Kosak et al. | 72/235 |

FOREIGN PATENT DOCUMENTS

| | | | |
|---|---|---|---|
| 0348913 | 1/1990 | European Pat. Off. | 72/225 |
| 0089501 | 3/1990 | Japan | 72/225 |

*Primary Examiner*—Lowell A. Larson
*Assistant Examiner*—Thomas C. Schoeffler
*Attorney, Agent, or Firm*—Cohen, Pontani, Lieberman, Pavane

[57] ABSTRACT

A rolling train for rolling girder sections includes at least one two-high reversing roughing stand and a plurality of subsequent universal stands for work rolling and finish rolling. Two universal stands and an upsetting stand are combined to form a reversing tandem group. A universal sizing stand for passing rolling is arranged immediately subsequent to the tandem group. The universal stands of the tandem group have double-cone shaped vertical rolls and the universal sizing stand has cylindrical vertical rolls. The girder section is rolled in several successive passes with the flanges of the section being directed outwardly and the outwardly directed flanges are rolled so as to extend parallel in a last smoothing pass.

2 Claims, 1 Drawing Sheet

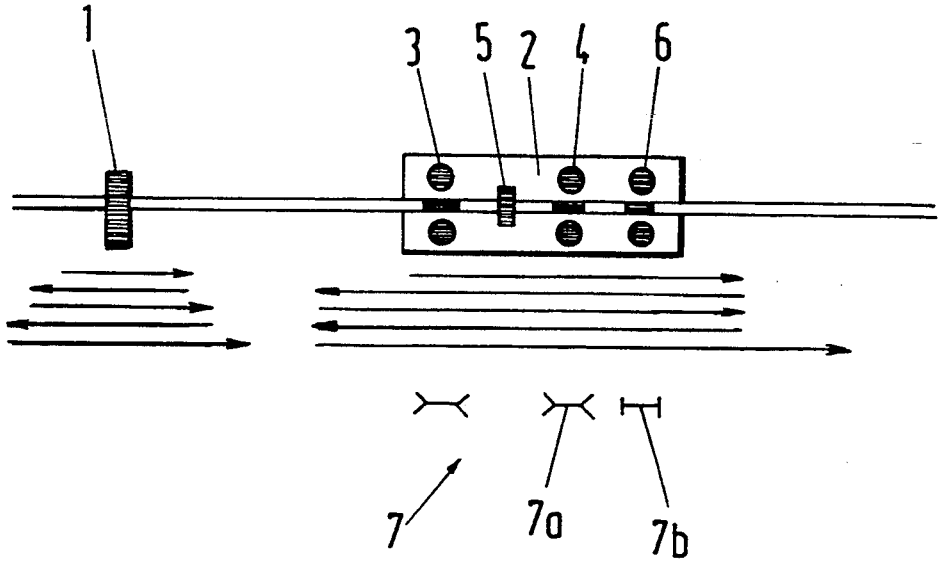
1
3
5
2
4
6
7
7a
7b

ROLLING TRAIN FOR ROLLING GIRDER SECTIONS

BACKGROUND OF THE INVENTION

1. Field of the Invention

The present invention relates to a rolling train for rolling girder sections. The rolling train includes at least one two-high reversing roughing stand and several subsequent universal stands for work rolling and finish rolling, wherein two universal stands and an upsetting stand are combined into a reversing tandem group.

2. Description of the Related Art

European Patent No. 02 56 409 discloses a section steel rolling mill with a two-high reversing roughing stand, and with a universal work stand and a flange upsetting stand combined to form a reversing tandem group, as well as with a universal finishing stand provided at the exit side. The section steel rolling mill illustrated in FIG. 1 of European Patent 02 56 409 provides for roughing in the two-high reversing roughing stand in 7 to 15 passes before the preformed girder is transferred to the reversing tandem stand group. By repeatedly rolling the preformed girder in 3 to 5 passes, the desired section is obtained approximately and, after the last pass and after the girder flanges have been rolled to the exact desired width, the girder is introduced into a finishing stand. The subsequent universal finishing pass rolls the girder into its final shape.

It is the intention in the European Patent 02 56 409 to improve this prior art which is referred to as being complicated and proposes to integrate the universal finishing stand into the reversing tandem stand group. Simultaneously, it is provided that, by an appropriate construction of the rolls of the universal work stand and the universal finishing stand, the girder section is alternatingly rolled into a H-shape and a X-shape, wherein the last pass is rolled in a H-shape. For this purpose, the vertical rolls of the universal work stand are constructed with a slight double-cone shape, while the universal finishing stand is equipped with cylindrical vertical rolls. In the prior art, this configuration of rolls and method of operation is mentioned as providing an advantageous kneading of the root portions of the flange.

This proposed arrangement of stands for carrying out the above-described rolling method on the rolling mill does reduce the investments required for the rolling mill as compared to known rolling mills because it omits a universal finishing stand and an upsetting stand. However, there is the simultaneous disadvantage that the universal finishing stand always participates in the deformation of the girder during the reversing passes in the reversing tandem group and, thus, is subject to the same wear as the universal work stand. Since the universal finishing stand is also utilized for the final finishing pass, the wear to be expected will make it necessary to exchange the rolls of this universal finishing stand frequently if a decrease in quality is unacceptable. Accordingly, the advantage achieved by the less complicated or expensive construction is eliminated because the costs saved by the omitted separate finishing stand and the corresponding upsetting stand are compensated by the additional costs for the rolls.

SUMMARY OF THE INVENTION

Therefore, starting from the above-described state of the art, it is the primary object of the present invention to provide a rolling train for rolling girder sections and a method of rolling these girder sections which make it possible to manufacture at relatively low investment costs qualitatively high-grade girder sections with exact dimensions.

In accordance with the present invention, a universal sizing stand is arranged immediately following the tandem group, wherein the reversing universal stands of the tandem group have double-cone shaped vertical rolls and the universal sizing stand provided for passing rolling has cylindrical vertical rolls.

Accordingly, contrary to the teaching of European Patent 02 56 409, in accordance with the present invention, the finishing pass of the rolled girder is carried out as a smoothing pass in a separate universal sizing stand which immediately follows the tandem group. This sizing stand is provided for passing rolling and is open during the reversing pass in the tandem group. The rolls of the universal sizing stand are adjusted only for the last smoothing pass and the smoothing pass is then carried out with the adjusted rolls. In this manner, wear in the sizing stand is minimized, while the universal stands of the reversing tandem group both participate fully as work stands in the deformation of the preformed girder. Since the universal stands of the tandem group are provided with double-cone shaped vertical rolls, it is possible in accordance with the method of the present invention to roll the girder section in several subsequent passes with the flanges being always oriented outwardly, and the outwardly oriented flanges can be rolled so as to extend parallel in the last smoothing stand. This means that, simultaneously with the smoothing pass in the universal sizing stand, the flanges are bent upwardly to obtain the H-shaped section with a slight reduction of the pass. Preferably, the smoothing pass is carried out with a pass reduction of 5 to 20%.

The present invention provides the advantage that, even though the reversing tandem group for reversing rolling of the girder is followed by a sizing stand which rolls exactly to shape and even though the structural requirements are greater than in accordance with European Patent 02 56 409, the rolling mill operates more economically and provides better final qualities because the excellent accuracy to shape which can be achieved and the low wear of the universal stand which carries out the final pass. The universal sizing stand which carries out only slight pass reductions can be of lighter construction than the universal work stands. An additional upsetting stand, as shown in FIG. 1 of European Patent 02 56 409, is not required.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWING

In the Drawing:

The single FIGURE of the drawing schematically illustrates an embodiment of a rolling train according to the present invention.

DESCRIPTION OF THE PREFERRED EMBODIMENT

In the rolling train schematically illustrated in the drawing, ingots arriving from a furnace are rough rolled in the two-high reversing roughing stand 1, for example, in 7 passes, as symbolically shown by means of arrows underneath the two-high reversing roughing stand 1. Subsequently, the girder section preformed in this manner is transferred to a reversing tandem stand group 2 which is composed of a reversible universal work stand 3, the also reversible universal work stand 4 and an upsetting stand 5 arranged between the universal work stands 3 and 4. A sizing stand 6 is arranged immediately following the reversing tandem group 2. The sizing stand 6 is also a universal stand but is not a reversing stand.

In the method according to the present invention, as symbolically shown by arrows underneath the reversing tandem stand group 2, the rough rolled girder section initially travels through the universal work stand 3, the upsetting stand 5 and the universal work stand 4. Subsequently, the girder section travels through the open sizing stand 6 in a passing operation and then travels again in a reversing pass in reverse sequence through the universal work stand 4, the upsetting stand 5 and the universal work stand 3. After again reversing its direction, the girder section travels once again through the universal work stand 3, the upsetting stand 5 and the universal work stand 4 and is then finish rolled in the sizing stand 6 which in the meantime has been adjusted to the final section dimensions.

As generally denoted by reference numerals 7 and shown underneath the pass sequence schedule, the flanges of the girder section are oriented outwardly *7a* in the universal work stands 3 and 4 and the girder section is rolled as a so-called butterfly section. It is only in the last pass within the sizing stand 6 that the outwardly directed flanges are rolled so as to extend parallel resulting in the H-section *7b*. During the last passage through the reversing tandem stand group 2, the deforming pass on the second universal work stand 4 can be omitted, so that the second to last pass is an upsetting pass on the upsetting stand 5.

It should be understood that the preferred embodiments and examples described are for illustrative purposes only and are not to be construed as limiting the scope of the present invention which is properly delineated only in the appended claims.

What is claimed is:

1. A method of rolling girder sections on a rolling train, the rolling train including at least one two-high reversing roughing stand and wherein two universal stands and an upsetting stand are combined to form a reversing tandem group, a universal sizing stand for passing rolling being arranged immediately following the tandem group, the universal stands of the tandem group having double-cone shaped vertical rolls and the universal sizing stand having cylindrical vertical rolls, the method comprising the steps of:

(a) moving the girder section in a plurality of successive reversing passes within the reversing tandem group and the immediately following universal sizing stand;

(b) rolling the girder section in the plurality of successive reversing passes with outwardly directed flanges in the tandem group while maintaining the universal sizing stand in an open position; and (c) adjusting the universal sizing stand and carrying out a final smoothing pass in the universal sizing stand for rolling the outwardly directed flanges so as to extend parallel to each other; said smoothing pass being carried out with a pass reduction of 5% to 20%.

2. The method according to claim 1, additionally comprising maintaining one of the universal stands of the tandem group in an open position while performing said final smoothing pass of step (c).

* * * * *